US006623541B2

(12) United States Patent
Sakaki et al.

(10) Patent No.: US 6,623,541 B2
(45) Date of Patent: Sep. 23, 2003

(54) SINTERED RARE EARTH MAGNET AND MAKING METHOD

(75) Inventors: Kazuaki Sakaki, Takefu (JP); Masanobu Shimao, Takefu (JP); Hajime Nakamura, Takefu (JP); Takehisa Minowa, Takefu (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 0 days.

(21) Appl. No.: 09/916,255

(22) Filed: Jul. 30, 2001

(65) Prior Publication Data

US 2002/0036031 A1 Mar. 28, 2002

(30) Foreign Application Priority Data

Jul. 31, 2000 (JP) ..... 2000-231244
Jul. 31, 2000 (JP) ..... 2000-231248

(51) Int. Cl.[7] ..... C22C 29/12

(52) U.S. Cl. ..... 75/232; 75/246; 427/127; 428/900; 419/29; 148/303; 148/122; 148/276; 148/281; 148/286; 148/287

(58) Field of Search ..... 148/303, 101, 148/103, 122, 276, 277, 281, 282, 284, 286, 287; 419/26, 29, 38; 427/127; 428/900, 928, 926, 446, 447, 448; 75/232, 245, 246

(56) References Cited

U.S. PATENT DOCUMENTS 4,284,440 A * 8/1981 Tokunaga et al. ..... 148/303
4,902,357 A * 2/1990 Imaizumi ..... 148/101
5,154,978 A * 10/1992 Nakayama et al. ..... 427/129
5,244,510 A * 9/1993 Bogatin ..... 148/104
5,781,843 A * 7/1998 Anderson et al. ..... 419/29
5,840,375 A * 11/1998 Katsumi et al. ..... 427/127
6,080,498 A * 6/2000 Kikui et al. ..... 204/192.1

FOREIGN PATENT DOCUMENTS

| | | |
|---|---|---|
| JP | 56-81908 | 7/1981 |
| JP | 57-17109 | 1/1982 |
| JP | 58-48608 | 3/1983 |
| JP | 61-87310 | 5/1986 |
| JP | 61-148808 | 7/1986 |
| JP | 61-195964 | * 8/1986 |
| JP | 3-129702 | 6/1991 |
| JP | 11-87119 | 3/1999 |

OTHER PUBLICATIONS

Abstract of Japanese 3129702.

Abstract of Japanese 11087119.

* cited by examiner

*Primary Examiner*—John Sheehan

(57) ABSTRACT

A sintered rare earth magnet consisting essentially of 20–30% by weight of R (wherein R is Sm or a mixture of Sm and another rare earth element), 10–45% by weight of Fe, 1–10% by weight of Cu, 0.5–5% by weight of Zr, and the balance of Co has on its surface a composite layer containing $Sm_2O_3$ and/or $CoFe_2O_4$ in Co or Co and Fe. The magnet is resistant to hydrogen embrittlement.

24 Claims, 6 Drawing Sheets

10μm

10μm

SINTERED RARE EARTH MAGNET AND MAKING METHOD

This invention relates to a $Sm_2Co_{17}$ base magnet for use in motors intended for long-term exposure to a hydrogen atmosphere and a method for preparing the same.

BACKGROUND OF THE INVENTION

Metal compounds of rare earth elements and transition metals have the nature that hydrogen can penetrate between crystal lattices, that is, hydrogen is absorbed in and released from the alloy. This nature is utilized in a variety of applications. One example is a hydrogen battery based on a hydrogen storage alloy as typified by $LaNi_5$. In connection with rare earth magnets, hydriding is utilized as means for pulverizing $R_2Fe_{14}B$ base alloys and also in the manufacture of bonded $R_2Fe_{14}B$ base magnets (HDDR method, see JP-A 3-129702).

However, hydrogen embrittlement is incurred when alloys or magnets are hydrided and dehydrided. When motors using rare earth magnets are used in a hydrogen atmosphere, there arises the problem that magnet blocks can be cracked, creviced and even pulverized.

Currently available sintered rare earth magnets include $R_2Fe_{14}B$, $SmCo_5$, and $Sm_2Co_{17}$ base magnets. In general, with respect to hydrogen, the 1-5 crystal structure has a lower plateau pressure than the 2-17 crystal structure, and the 2-7 crystal structure has a lower plateau pressure than the 1-5 crystal structure. That is, rare earth-rich (referred to as R-rich, hereinafter) alloys are more likely to absorb hydrogen and more susceptible to hydrogen embrittlement.

Often the $R_2Fe_{14}B$ base magnet is surface treated as by plating or resin coating for the purpose of improving corrosion resistance although the surface treatment is not an effective means for preventing hydrogen embrittlement. As a solution to the problem of hydrogen embrittlement, it was proposed in JP-A 11-87119 to incorporate a hydrogen storage alloy into a surface treating coat on a $R_2Fe_{14}B$ base magnet. The thus treated $R_2Fe_{14}B$ base magnet does not undergo hydrogen embrittlement in a hydrogen atmosphere having a pressure of lower than 0.1 MPa, on account of an R-rich phase included therein. In a hydrogen atmosphere having a higher pressure, however, the magnet still undergoes hydrogen embrittlement and can thus be cracked, creviced and even pulverized.

Like the $R_2Fe_{14}B$ base magnet, the $SmCo_5$ base magnet contains an R-rich phase and the $SmCo_5$ phase, the major phase has a plateau pressure of about 0.3 MPa. Then in a hydrogen atmosphere having a pressure in excess of 0.3 MPa, the $SmCo_5$ base magnet undergoes hydrogen embrittlement and can thus be cracked, creviced and even pulverized.

The $Sm_2Co_{17}$ base magnet is less susceptible to hydrogen embrittlement since it has a major phase of 2-17 structure and is less R-rich than the $R_2Fe_{14}B$ and $SmCo_5$ base magnets, and does not contain an R-rich phase. In a hydrogen atmosphere having a pressure in excess of 1 MPa, however, the $Sm_2Co_{17}$ base magnet yet undergoes hydrogen embrittlement like other rare earth magnets, and can thus be cracked, creviced and even pulverized.

SUMMARY OF THE INVENTION

An object of the invention is to solve the above-described problems of prior art rare earth magnets that they, when exposed to a hydrogen atmosphere, undergo hydrogen embrittlement and can thus be cracked, creviced and even pulverized, and to provide a sintered $Sm_2Co_{17}$ base magnet which has solved the problems and a method for preparing the same.

It has been found that by forming a composite layer containing $Sm_2O_3$ and/or $CoFe_2O_4$ in Co or Co and Fe on a surface of a sintered $Sm_2Co_{17}$ base magnet, the sintered $Sm_2Co_{17}$ base magnet becomes unsusceptible to hydrogen embrittlement even in a hydrogen atmosphere and thus suitable for use in motors or other equipment intended for long-term exposure to a hydrogen atmosphere. In the manufacture of a sintered $Sm_2Co_{17}$ base magnet, by subjecting a sintered magnet after sintering and aging to machining and then optimum heat treatment, a hydrogen attack-resistant layer can be formed on the magnet surface at no sacrifice of magnetic properties.

The sintered $Sm_2Co_{17}$ base magnet with the composite layer on the surface thereof is prone to chipping and thus requires careful handling during product assembly because the magnet can otherwise be chipped. A chip on the rare earth magnet does not affect its magnetic properties, but can substantially degrade hydrogen embrittlement resistance to the same level as in the absence of the surface layer. That is, the sintered $Sm_2Co_{17}$ base magnet with the composite layer thereon, when held in a hydrogen atmosphere having a pressure in excess of 1 MPa, still has a likelihood that it undergoes hydrogen embrittlement and is cracked, creviced and even pulverized. It has been found that by applying a resin coating on the surface of the composite layer on the sintered $Sm_2Co_{17}$ base magnet, an effect of preventing the magnet from chipping is achieved. The resin-coated, sintered $Sm_2Co_{17}$ base magnet is thus best suited for use in motors or other equipment intended for long-term exposure to a hydrogen atmosphere.

In a first aspect, the invention provides a sintered rare earth magnet consisting essentially of 20 to 30% by weight of R wherein R is samarium or at least two rare earth elements containing at least 50% by weight of samarium, 10 to 45% by weight of iron, 1 to 10% by weight of copper, 0.5 to 5% by weight of zirconium, and the balance of cobalt and incidental impurities. The sintered rare earth magnet has on its surface a composite layer containing $Sm_2O_3$ or $CoFe_2O_4$ or both in Co or Co and Fe. In a preferred embodiment, the sintered rare earth magnet further has a resin coating on the composite layer.

In a second aspect, the invention provides a method for preparing a sintered rare earth magnet, comprising the steps of casting an alloy of the same composition as defined above; grinding the alloy, followed by comminution, compacting in a magnetic field, sintering and aging to form a sintered magnet; cutting and/or polishing the sintered magnet for surface finishing; and heat treating in an atmosphere having an oxygen partial pressure of $10^{-6}$ to 152 torr for about 10 minutes to 20 hours. The method may further include the step of applying a resin coating on the surface of the sintered magnet after the heat treatment, typically by spray coating, electrodeposition, powder coating or dipping.

DESCRIPTION OF THE PREFERRED EMBODIMENT

Figure 1:
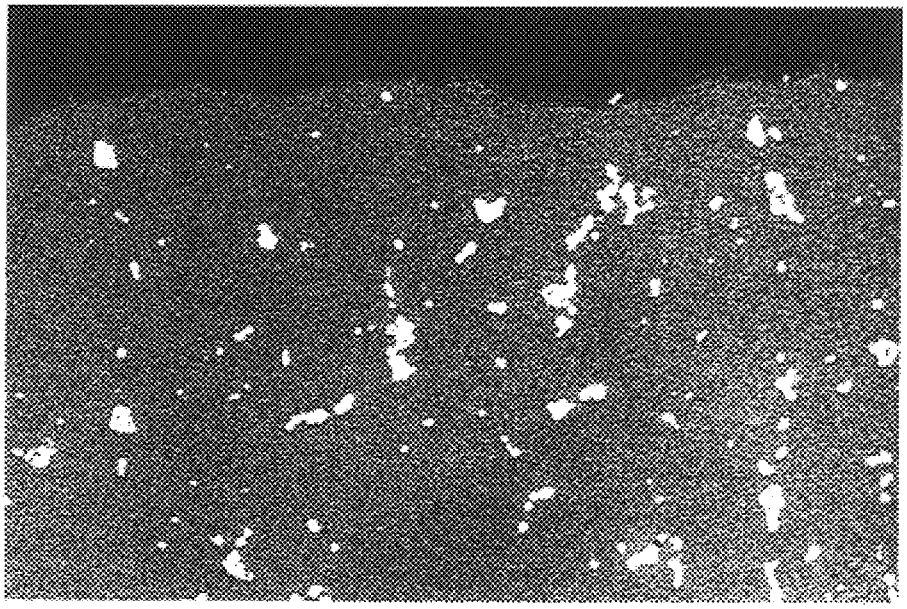
FIG. 1 is a SEN photomicrograph of the magnet sample as heat treated in vacuum (oxygen partial pressure $10^{-3}$ torr) at 400° C. for 2 hours in Example 1.

The $Sm_2Co_{17}$ base permanent magnet of the invention has a composition consisting essentially of 20 to 30% by weight of samarium (Sm) or at least two rare earth elements containing at least 50% by weight of samarium, 10 to 45% by weight of iron (Fe), 1 to 10% by weight of copper (Cu), 0.5 to 5% by weight of zirconium (Zr), and the balance of cobalt (Co) and incidental impurities. The rare earth elements other than samarium include neodymium (Nd), cerium (Ce), praseodymium (Pr) and gadolinium (Gd), but are not limited thereto. Satisfactory magnetic properties are lost if the content of Sm in the rare earth mixture is less than 50% by weight, or if the (total) content of rare earth element(s) in the magnet is less than 20% by weight or more than 30% by weight.

The sintered $Sm_2Co_{17}$ base magnet of the invention has on the surface of the sintered magnet of the above-defined composition a composite layer which contains $Sm_2O_3$ and/or $CoFe_2O_4$ in Co or Co and Fe and which is effective for preventing hydrogen embrittlement.

The composite layer preferably has a thickness of 0.1 $\mu$m to 3 mm, more preferably 1 to 500 $\mu$m, and even more preferably 1 to 50 $\mu$m. Differently stated, the composite layer preferably has a thickness of 0.01 to 2% of the thickness of the magnet. A layer with a thickness of less than 0.1 $\mu$m may fail to provide hydrogen embrittlement resistance whereas a layer with a thickness of more than 3 mm is effective for protecting the magnet from hydrogen embrittlement, but can detract from the magnetic properties.

The layer containing $Sm_2O_3$ or $CoFe_2O_4$ in Co or Co and Fe means that particles of $Sm_2O_3$ or $CoFe_2O_4$ having a particle size of about 1 to 100 nm are dispersed in Co or a mixture of Co and Fe.

Any desired method may be used in preparing the sintered magnet having a composite layer containing $Sm_2O_3$ and/or $CoFe_2O_4$ on its surface. In a preferred embodiment, a method for preparing the sintered magnet involves the steps of casting an alloy of the above-defined composition, grinding the alloy, comminuting, compacting in a magnetic field, sintering and aging to form a sintered magnet, surface finishing the sintered magnet, and thereafter, heat treating the magnet. Alternatively, the aging is effected subsequent to the surface finishing.

Described below is a preferred method for preparing the $Sm_2Co_{17}$ base magnet of the invention. The $Sm_2Co_{17}$ base magnet alloy is prepared by first melting raw materials within the above-defined composition range in a non-oxidizing atmosphere, as by high-frequency induction heating, and casting the melt.

The $Sm_2Co_{17}$ base magnet alloy thus cast is crushed and then preferably comminuted to a mean particle size of 1 to 10 $\mu$m, especially about 5 $\mu$m. Crushing or coarse grinding may be performed, for example, in an inert gas atmosphere such as $N_2$, Ar and the like by means of a jaw crusher, Brown mill or pin mill or by hydriding. Comminution or fine grinding may be performed by means of a wet ball mill using alcohol or hexane as the solvent, a dry ball mill in an inert gas atmosphere such as $N_2$, Ar and the like, or a jet mill using an inert gas stream such as $N_2$, Ar and the like.

The comminuted powder is then compacted by means of a magnetic pressing machine capable of compression in a magnetic field of preferably at least 10 kOe, and preferably under a pressure of 500 kg/cm$^2$ to less than 2,000 kg/cm$^2$. The compact is then heated for sintering and solution treatment in a heating furnace having a non-oxidizing gas atmosphere such as argon, preferably at a temperature of 1,100 to 1,300° C., more preferably 1,150 to 1,250° C. and preferably for about ½ to 5 hours. Immediately after the sintering step, the compact is quenched.

The sintered magnet is then aged. The aging treatment includes holding in an argon atmosphere, preferably at a temperature of 700 to 900° C., more preferably 750 to 850° C., and preferably for about 5 to 40 hours and then slowly cooling, for example, at a rate of −1.0° C./min. The aged compact is cut and/or polished for surface finishing.

Subsequent to the surface finishing, the magnet is heat treated in an inert gas (Ar, $N_2$, etc), air or vacuum atmosphere having an oxygen partial pressure of $10^{-6}$ to 152 torr, preferably $10^{-3}$ to 152 torr, more preferably 100 to 152 torr, for about 10 minutes to 20 hours, and preferably at a temperature of 80 to 850° C. Particularly when exposure to high-pressure hydrogen gas is intended, heat treatment at a temperature of 400 to 600° C. is preferred. Also preferably, heat treatment is effected in an atmosphere having an oxygen partial pressure of 1 to 152 torr and thus containing a relatively large amount of oxygen. With respect to the time and temperature of heat treatment, a time of less than 10 minutes is inappropriate because more variations are incurred whereas a time of more than 20 hours is inefficient and can degrade the magnetic properties. A temperature of lower than 80° C. requires a longer time of heat treatment until a rare earth magnet (having a composite layer formed thereon) with improved hydrogen attack resistance is obtained, and the process becomes inefficient. A temperature in excess of 850° C. can cause the magnet to undergo phase transformation and degrade its magnetic properties.

The heat treating time is preferably about 10 minutes to 10 hours, more preferably about 1 to 5 hours, within which a composite layer, preferably having a thickness of 0.1 $\mu$m to 3 mm, is formed on the magnet surface as a hydrogen embrittlement-inhibiting layer. The composite layer has fine particles of $Sm_2O_3$ and/or $CoFe_2O_4$ dispersed mainly in Co or Co and Fe as previously described. In the absence of a Co matrix, the composite layer is ineffective for inhibiting hydrogen embrittlement and itself acts to degrade the magnetic properties.

In a further preferred embodiment of the invention, a resin coating is formed on the surface of the sintered rare earth magnet having the composite layer containing $Sm_2O_3$ and/or $CoFe_2O_4$ in Co or Co and Fe. The resin coating is formed on the composite layer, for example, by spray coating, electrodeposition, powder coating or dipping.

The resin applied herein is not critical and may be selected from thermosetting resins and thermoplastic resins, for example, acrylic, epoxy, phenolic, silicone, polyester, polyimide, polyamide and polyurethane resins. Use of thermosetting resins is preferred since they are more heat resistant. The resins used herein have a molecular weight (Mw) of about 200 to about 100,000 or more, preferably about 200 to 10,000. Among others, oil type resins are preferred.

The resin coating technique is selected from conventional coating techniques such as spray coating, electrodeposition, powder coating, and dipping. The resin coating usually has a thickness of 1 $\mu$m to 3 mm, preferably 10 $\mu$m to 1 mm, and more preferably 10 $\mu$m to 500 $\mu$m, although the thickness depends on the dimensions of the magnet. A resin coating of thinner than 1 $\mu$m is difficult to evenly apply and thus sometimes fails to prevent the magnet from chipping. A resin coating of thicker than 3 mm may be time consuming and expensive, leading to inefficient production.

The sintered rare earth magnet thus obtained is resistant to degradation or cracking even when hydrided under a hydrogen pressure of 1 to 5 MPa at 25° C. and thus suitable for use in motors or the like.

Example

Examples of the invention are given below by way of illustration and not by way of limitation. Abbreviation VSM is a vibrating sample magnetometer, XRD is x-ray diffraction analysis, and SEM is a scanning electron microscope.

Example 1

A $Sm_2Co_{17}$ base magnet alloy was prepared by mixing raw materials so as to give a composition consisting of 25.5 wt % Sm, 14.0 wt % Fe, 4.5 wt % Cu, 3.0 wt % Zr and the balance Co, melting the mixture in an alumina crucible in a high-frequency heating furnace having an argon gas atmosphere, and casting the melt in a mold.

The $Sm_2Co_{17}$ base magnet alloy was crushed by a jaw crusher and a Brown mill to a size of less than about 500 $\mu$m, and then comminuted to a mean particle size of 5 $\mu$m by a jet mill using a nitrogen stream. Using a magnetic pressing machine, the comminuted powder was compacted under a magnetic field of 15 kOe and a pressure of 1.5 t/cm$^2$. Using a heating furnace, the compact was sintered in an argon atmosphere at 1,200° C. for 2 hours and then subjected to solution treatment in an argon atmosphere at 1,185° C. for one hour. After the solution treatment, the sintered magnet was quenched. The sintered magnet was aged by holding in an argon atmosphere at 800° C. for 10 hours and slowly cooling to 400° C. at a rate of −1.0° C./min. From the sintered magnet, a magnet block of 5×5×5 mm was machined and measured for magnetic properties by a VSM.

The magnet block was heat treated in vacuum (oxygen partial pressure $10^{-3}$ torr) at 400° C. for 2 hours and then slowly cooled to room temperature. The heat treated sample (for a hydriding test) was measured for magnetic properties by a VSM, identified for phase by XRD analysis, and observed for texture under SEM.

The sample was subjected to a hydriding test by placing the sample in a pressure vessel, sealing under conditions: hydrogen, 3 MPa and 25° C., and allowing to stand under the conditions for 24 hours. The magnet sample was removed from the vessel and measured for magnetic properties by a VSM again.

Example 2

A sintered magnet was prepared using the same composition and procedure as in Example 1. Similarly, a magnet block of 5×5×5 mm was machined from the sintered magnet and measured for magnetic properties by a VSM.

The magnet block was heat treated in vacuum (oxygen partial pressure $10^{-3}$ torr) at 500° C. for 2 hours and then slowly cooled to room temperature. The heat treated sample (for a hydriding test) was measured for magnetic properties by a VSM and observed for texture under SEM.

The sample was subjected to the same hydriding test as in Example 1. The magnet sample was removed from the vessel and measured for magnetic properties by a VSM again.

Comparative Example 1

A sintered magnet was prepared using the same composition and procedure as in Example 1. Similarly, a magnet block of 5×5×5 mm was machined from the sintered magnet. This magnet sample was measured for magnetic properties by a VSM, identified for phase by XRD analysis and observed for texture under SEM.

The magnet sample was subjected to the same hydriding test as in Example 1. The magnet sample was removed from the vessel and measured for magnetic properties by a VSM again.

Figure 2:
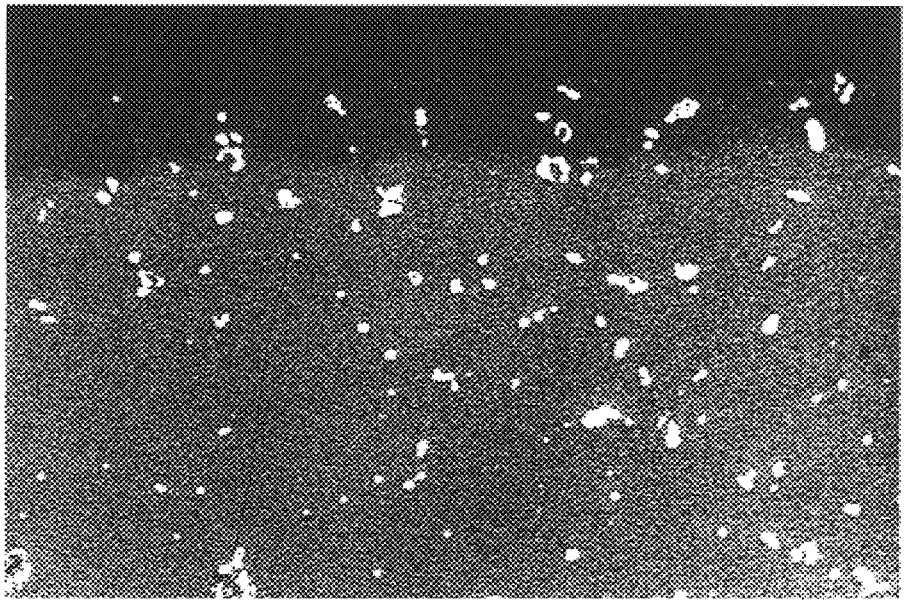
FIG. 2 is a SEM photomicrograph of the magnet sample as heat treated in vacuum (oxygen partial pressure $10^{-3}$ torr) at 500° C. for 2 hours in Example 2.
Figure 3:
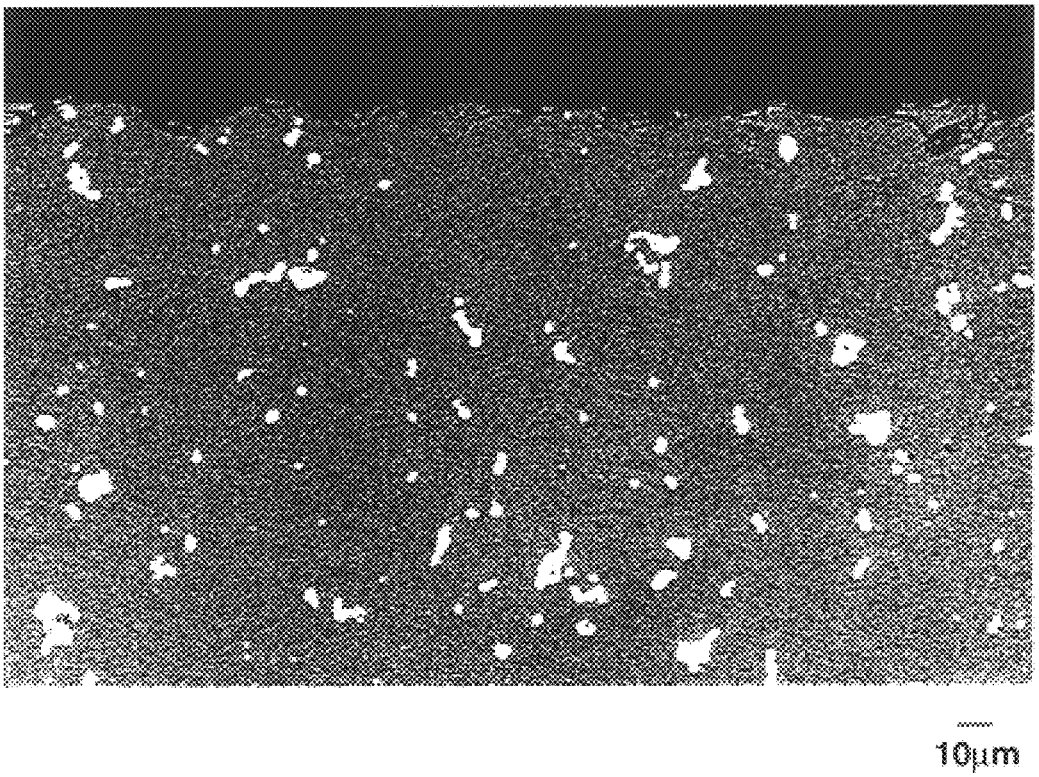
FIG. 3 is a SEM photomicrograph of the magnet sample in Comparative Example 1.

FIGS. 1, 2 and 3 are photomicrographs showing the texture of the samples of Example 1, Example 2 and Comparative Example 1, respectively. Table 1 sets forth heat treatment conditions, hydriding test conditions, the state after the hydriding test, and the thickness of the composite layer containing $Sm_2O_3$ in Co or Co+Fe. After the hydriding test, Examples 1 and 2 remained unchanged, whereas Comparative Example 1 was pulverulent. It is thus evident that Examples 1 and 2 did not undergo hydrogen embrittlement. Table 2 sets forth the magnetic properties of the magnets before and after the heat treatment and after the hydriding test. After the heat treatment and after the hydriding test, the magnetic properties of Examples 1 and 2 remained substantially unchanged, indicating that Examples 1 and 2 prevented degradation of magnetic properties by heat treatment and hydrogen embrittlement. The magnetic properties of Comparative Example 1 after hydriding were unmeasurable because the sample became pulverulent by hydriding.

TABLE 1

| | Heat treatment | Hydriding test | State after hydriding | Thickness of composite layer |
|---|---|---|---|---|
| E1 | 400° C./2 hr | 3 MPa/25° C./ | unchanged | 1 $\mu$m |
| E2 | 500° C./2 hr | 24 hr | unchanged | 20 $\mu$m |
| CE1 | — | | pulverulent | — |

TABLE 2

| | Before heat treatment | | | After heat treatment | | | After hydriding test | | |
|---|---|---|---|---|---|---|---|---|---|
| | Br [kG] | iHc [kOe] | (BH) max [MGOe] | Br [kG] | iHc [kOe] | (BH) max [MGOe] | Br [kG] | iHc [kOe] | (BH) max [MGOe] |
| E1 | 10.70 | 15.85 | 27.08 | 10.66 | 15.90 | 26.84 | 10.64 | 15.97 | 26.68 |
| E2 | 10.65 | 15.33 | 26.84 | 10.67 | 15.95 | 26.40 | 10.65 | 15.85 | 26.36 |
| CE1 | 10.69 | 15.36 | 27.09 | — | — | — | — | — | — |

Figure 4:
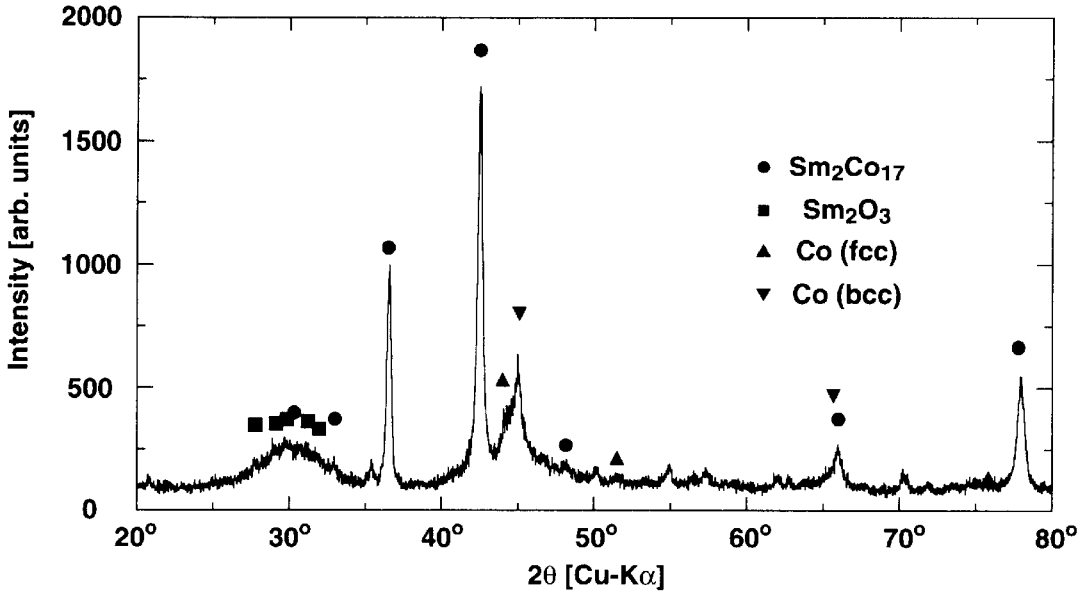
FIG. 4 is an XRD diagram of Example 1.
Figure 5:
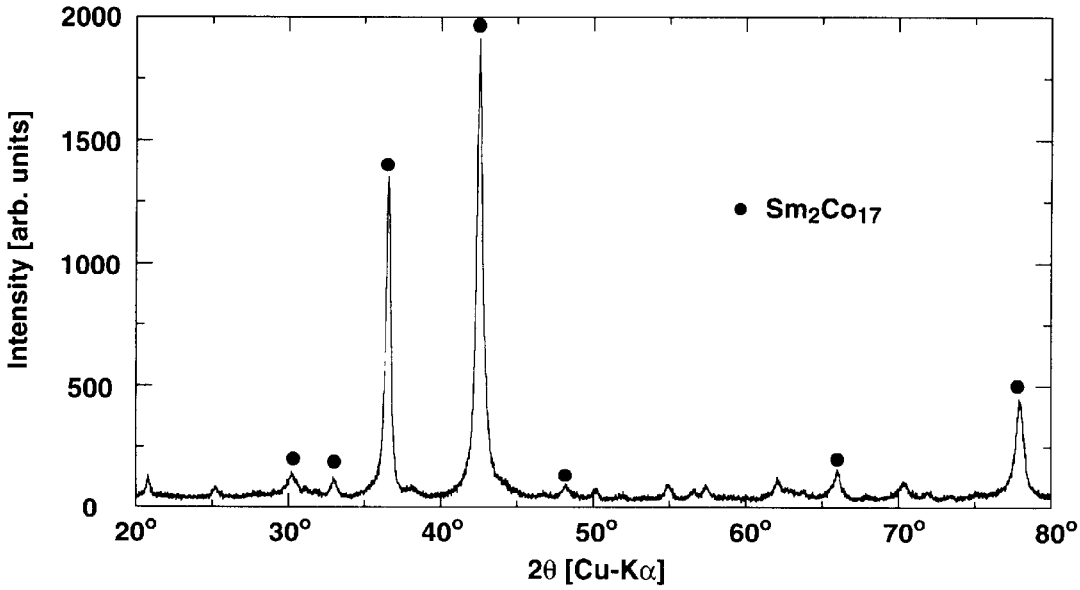
FIG. 5 is an XRD diagram of Comparative Example 1.

FIGS. 4 and 5 are XRD diagrams of Example 1 and Comparative Example 1, respectively. In the XRD diagram of Example 1, peaks of $Sm_2Co_{17}$ are found as well as peaks of Co (bcc and fcc) and $Sm_2O_3$. In the XRD diagram of Comparative Example 1, peaks of $Sm_2Co_{17}$ are found, but not peaks of Co (bcc and fcc) and $Sm_2O_3$.

Example 3

A $Sm_2Co_{17}$ base magnet alloy was prepared by mixing raw materials so as to give a composition consisting of 25.5 wt % Sm, 20.0 wt % Fe, 4.5 wt % Cu, 3.0 wt % Zr and the balance Co, melting the mixture in an alumina crucible in a high-frequency heating furnace having an argon gas atmosphere, and casting the melt in a mold.

The $Sm_2Co_{17}$ base magnet alloy was crushed by a jaw crusher and a Brown mill to a size of less than about 500 $\mu$m, and then comminuted to a mean particle size of 5 $\mu$m by a jet mill using a nitrogen stream. Using a magnetic pressing machine, the comminuted powder was compacted under a magnetic field of 15 kOe and a pressure of 1.5 t/cm$^2$. Using a heating furnace, the compact was sintered in an argon atmosphere at 1,200° C. for 2 hours and then subjected to solution treatment in an argon atmosphere at 1,185° C. for one hour. After the solution treatment, the sintered magnet was quenched. The sintered magnet was aged by holding in an argon atmosphere at 800° C. for 10 hours and slowly cooling to 400° C. at a rate of −1.0° C./min. From the sintered magnet, a magnet block of 5×5×5 mm was machined and measured for magnetic properties by a VSM.

The magnet block was heat treated in air (oxygen partial pressure 152 torr) at 400° C. for 2 hours and then slowly cooled to room temperature.

The magnet sample was subjected to a hydriding test by placing the sample in a pressure vessel, sealing under conditions: hydrogen, 3 MPa and 25° C., and allowing to stand under the conditions for 24 hours. The magnet sample was removed from the vessel and measured for magnetic properties by a VSM again.

Examples 4 and 5

A sintered magnet was prepared using the same composition and procedure as in Example 3. Similarly, a magnet block of 5×5×5 mm was machined from the sintered magnet and measured for magnetic properties by a VSM.

The magnet block was heat treated in vacuum (oxygen partial pressure $10^{-3}$ torr) at 500° C. for 2 hours in Example 4 or in vacuum (oxygen partial pressure $10^{-6}$ torr) at 600° C. for 2 hours in Example 5 and then slowly cooled to room temperature. The heat treated sample (for a hydriding test) was measured for magnetic properties by a VSM and observed for texture under SEM.

The sample was subjected to the same hydriding test as in Example 3. The magnet sample was removed from the vessel and measured for magnetic properties by a VSM again.

Comparative Example 2

A sintered magnet was prepared using the same composition and procedure as in Example 3. Similarly, a magnet block of 5×5×5 mm was machined from the sintered magnet. This sample was measured for magnetic properties by a VSM. The sample was subjected to the same hydriding test as in Example 3. The magnet sample was removed from the vessel and measured for magnetic properties by a VSM again.

Table 3 sets forth heat treatment conditions, hydriding test conditions, and the state after the hydriding test. After the hydriding test, Examples 3, 4 and 5 remained unchanged, whereas Comparative Example 2 was pulverulent. It is thus evident that Examples 3, 4 and 5 did not undergo hydrogen embrittlement.

Table 4 sets forth the magnetic properties of the magnets before and after the heat treatment and after the hydriding test. After the heat treatment and after the hydriding test, the magnetic properties of Examples 3, 4 and 5 remained substantially unchanged, indicating that Examples 3, 4 and 5 prevented degradation of magnetic properties by heat treatment and hydrogen embrittlement. The magnetic properties of Comparative Example 2 after hydriding were unmeasurable because the sample became pulverulent by hydriding.

TABLE 3

| | Heat treatment | Hydriding test | State after hydriding |
|---|---|---|---|
| E3 | 400° C./2 hr/air | 3 MPa/25° C./24 hr | unchanged |
| E4 | 500° C./2 hr/vacuum | | unchanged |
| E5 | 600° C./2 hr/vacuum | | unchanged |
| CE2 | — | | cracked |

TABLE 4

| | Before heat treatment | | | After heat treatment | | | After hydriding test | | |
|---|---|---|---|---|---|---|---|---|---|
| | Br [kG] | iHc [kOe] | (BH) max [MGOe] | Br [kG] | iHc [kOe] | (BH) max [MGOe] | Br [kG] | iHc [kOe] | (BH) max [MGOe] |
| E3 | 11.69 | 12.10 | 31.88 | 11.70 | 11.98 | 31.66 | 11.70 | 11.96 | 31.54 |

TABLE 4-continued

| | Before heat treatment | | | After heat treatment | | | After hydriding test | | |
|---|---|---|---|---|---|---|---|---|---|
| | Br [kG] | iHc [kOe] | (BH) max [MGOe] | Br [kG] | iHc [kOe] | (BH) max [MGOe] | Br [kG] | iHc [kOe] | (BH) max [MGOe] |
| E4 | 11.67 | 12.05 | 31.75 | 11.65 | 11.91 | 31.51 | 11.65 | 11.95 | 31.44 |
| E5 | 11.69 | 11.95 | 31.77 | 11.67 | 11.81 | 31.55 | 11.67 | 11.93 | 31.45 |
| CE2 | 11.73 | 11.58 | 31.95 | — | — | — | — | — | — |

Example 6

A sintered magnet was prepared using the same composition and procedure as in Example 3. Similarly, a magnet block of 5×5×5 mm was machined from the sintered magnet.

The magnet was heat treated as in Example 3 and then slowly cooled to room temperature, obtaining a sample for a hydriding test.

The magnet sample was subjected to a hydriding test by placing the sample in a pressure vessel, sealing under conditions: hydrogen, 3 MPa and 80° C., 120° C. or 160° C. and allowing to stand under the conditions for 24 hours. The magnet sample was removed from the vessel. The results are shown in Table 5.

TABLE 5

| | Heat treatment | | | Hydriding test | | | After hydriding test |
|---|---|---|---|---|---|---|---|
| No. 1 | 500° C. | 2 hr | air | 3 MPa | 80° C. | 24 hr | unchanged |
| | | | (152 | 3 MPa | 120° C. | 24 hr | unchanged |
| | | | torr) | 3 MPa | 160° C. | 24 hr | unchanged |
| No. 2 | 500° C. | 2 hr | $10^{-2}$ torr | 3 MPa | 80° C. | 24 hr | unchanged |
| | | | | 3 MPa | 120° C. | 24 hr | unchanged |
| | | | | 3 MPa | 160° C. | 24 hr | cracked |
| No. 3 | 500° C. | 2 hr | $10^{-6}$ torr | 3 MPa | 80° C. | 24 hr | unchanged |
| | | | | 3 MPa | 120° C. | 24 hr | pulverulent |
| | | | | 3 MPa | 160° C. | 24 hr | pulverulent |

Example 7

A $Sm_2Co_{17}$ base magnet alloy was prepared by mixing raw materials so as to give a composition consisting of 25.5 wt % Sm, 16.0 wt % Fe, 4.5 wt % Cu, 3.0 wt % Zr and the balance Co, melting the mixture in an alumina crucible in a high-frequency heating furnace having an argon gas atmosphere, and casting the melt in a mold.

The $Sm_2CO_{17}$ base magnet alloy was crushed by a jaw crusher and a Brown mill to a size of less than about 500 $\mu$m, and then comminuted to a mean particle size of 5 $\mu$m by a jet mill using a nitrogen stream. Using a magnetic pressing machine, the comminuted powder was compacted under a magnetic field of 15 kOe and a pressure of 1.5 t/cm$^2$. Using a heating furnace, the compact was sintered in an argon atmosphere at 1,195° C. for 2 hours and then subjected to solution treatment in an argon atmosphere at 1,180° C. for one hour. After the solution treatment, the sintered magnet was quenched. The sintered magnet was aged by holding in an argon atmosphere at 800° C. for 10 hours and slowly cooling to 400° C. at a rate of −1.0° C./min. From the sintered magnet, a magnet block of 5×5×5 mm was machined and measured for magnetic properties by a VSM.

The magnet block was heat treated in air at 500° C. for 2 hours and then slowly cooled to room temperature. The magnet block was identified for phase by XRD and observed for texture under SEM.

Figure 6:
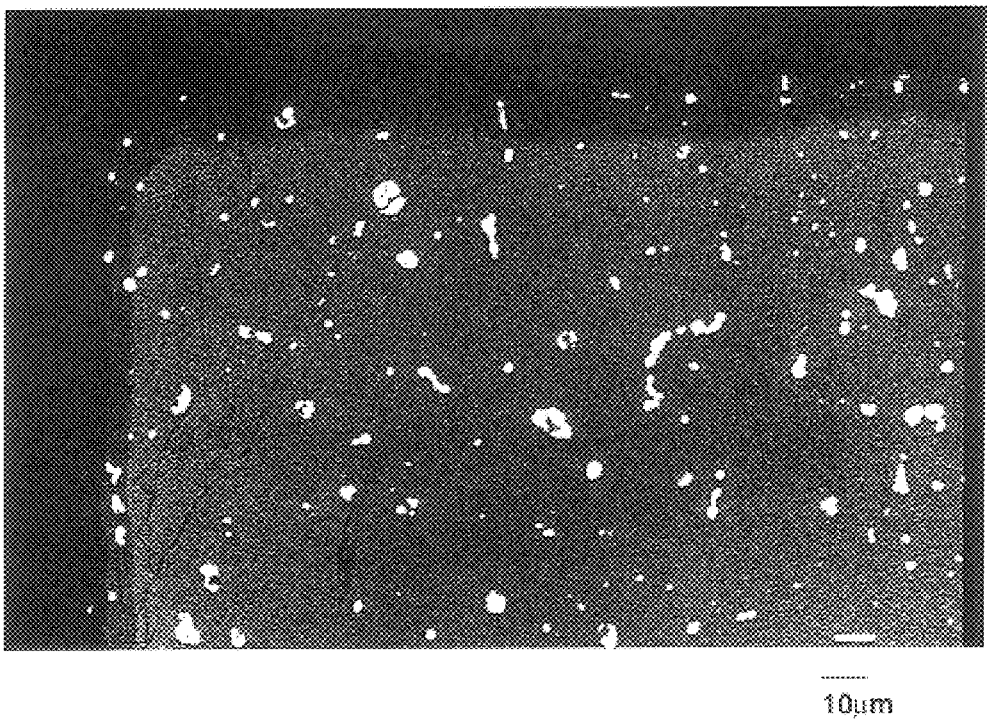
FIG. 6 is a SEM photomicrograph of the magnet as heat treated in air at 500° C. for 2 hours in Example 7.
Figure 9:
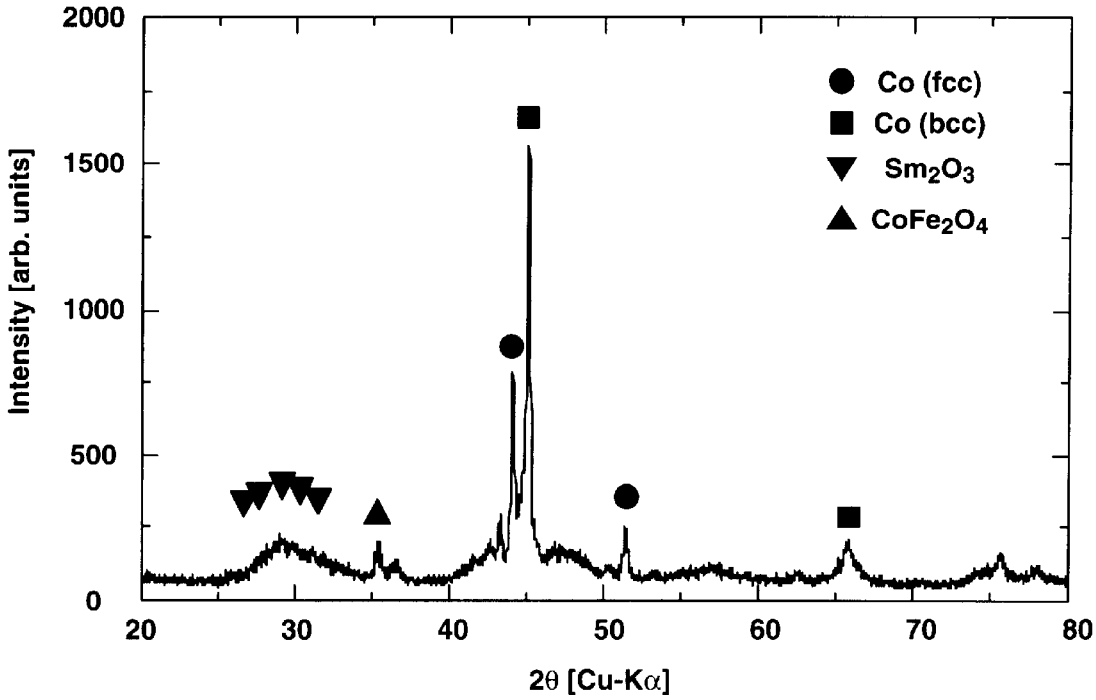
FIG. 9 is an XRD diagram of the magnet of Example 7.

FIG. 6 is a SEM photomicrograph of the magnet as heat treated in air at 500° C. for 2 hours. FIG. 9 is an XRD diagram of the same magnet.

An epoxy resin was spray coated onto the heat treated magnet. The coated magnet sample was measured for magnetic properties by a VSM.

The coated magnet sample was subjected to a hydriding test by placing the sample in a pressure vessel, sealing under conditions: hydrogen, 3 MPa and 25° C., and allowing to stand under the conditions for 24 hours. The magnet sample was removed from the vessel and measured for magnetic properties by a VSM again.

Example 8

A sintered magnet was prepared using the same composition and procedure as in Example 7. Similarly, a magnet block of 5×5×5 mm was machined from the sintered magnet and measured for magnetic properties by a VSM.

The magnet block was heat treated in air at 400° C. for 2 hours and then slowly cooled to room temperature. The magnet block was observed for texture under SEM.

Figure 7:
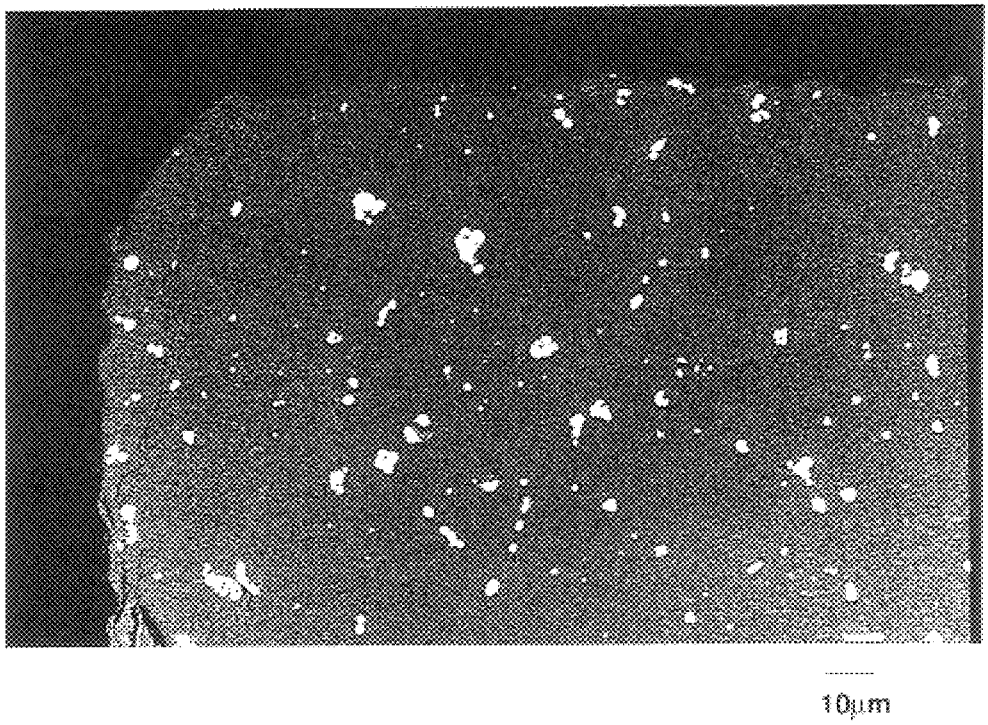
FIG. 7 is a SEM photomicrograph of the magnet as heat treated in air at 400° C. for 2 hours in Example 8.

FIG. 7 is a SEM photomicrograph of the magnet as heat treated in air at 400° C. for 2 hours.

An epoxy resin was spray coated onto the heat treated magnet. The coated magnet sample was measured for magnetic properties by a VSM.

The coated magnet sample was subjected to the same hydriding test as in Example 7. The magnet sample was removed from the vessel and measured for magnetic properties by a VSM again.

Example 9

A sintered magnet was prepared using the same composition and procedure as in Example 7. Similarly, a magnet block of 5×5×5 mm was machined from the sintered magnet.

As in Example 7, the magnet block was heat treated in air at 500° C. for 2 hours and then slowly cooled to room temperature.

As in Example 7, an epoxy resin was spray coated onto the heat treated magnet. The coated magnet sample was dropped from a height of 10 cm onto a steel plate before it was subjected to the same hydriding test as in Example 7. The magnet sample was removed from the vessel.

Comparative Example 3

A sintered magnet was prepared using the same composition and procedure as in Example 7. Similarly, a magnet block of 5×5×5 mm was machined from the sintered magnet and measured for magnetic properties by a VSM. It was also identified for phase by XRD analysis and observed for texture under SEM as in Example 7.

Figure 8:
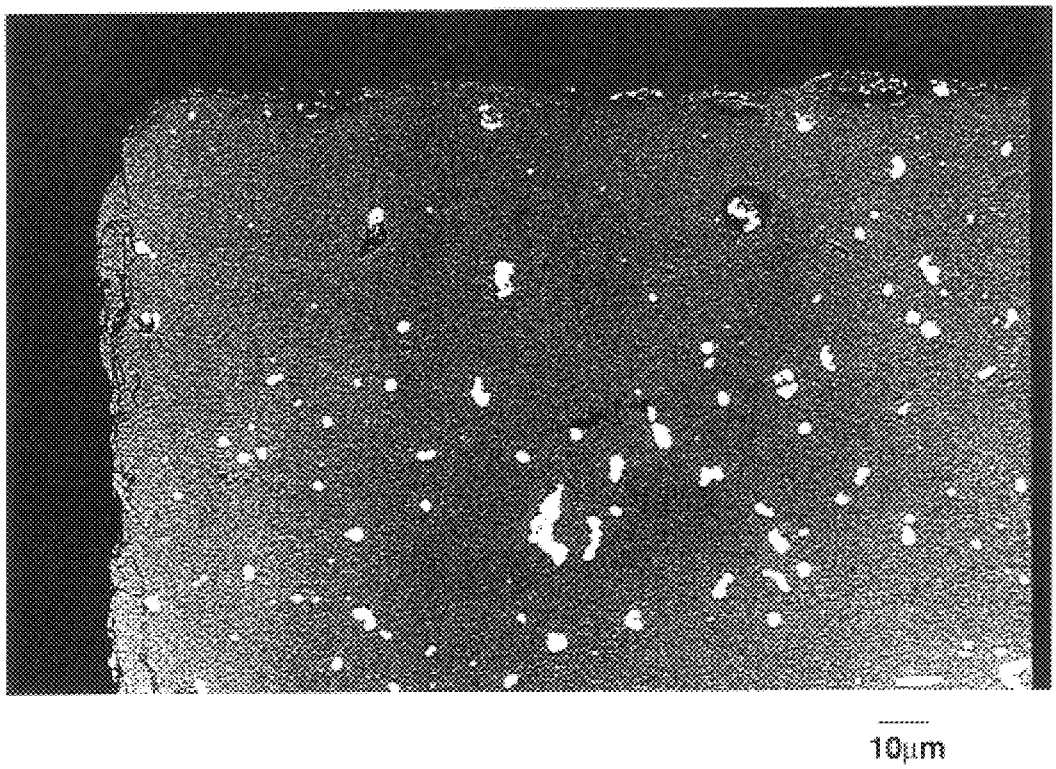
FIG. 8 is a SEM photomicrograph of the magnet of Comparative Example 3.
Figure 10:
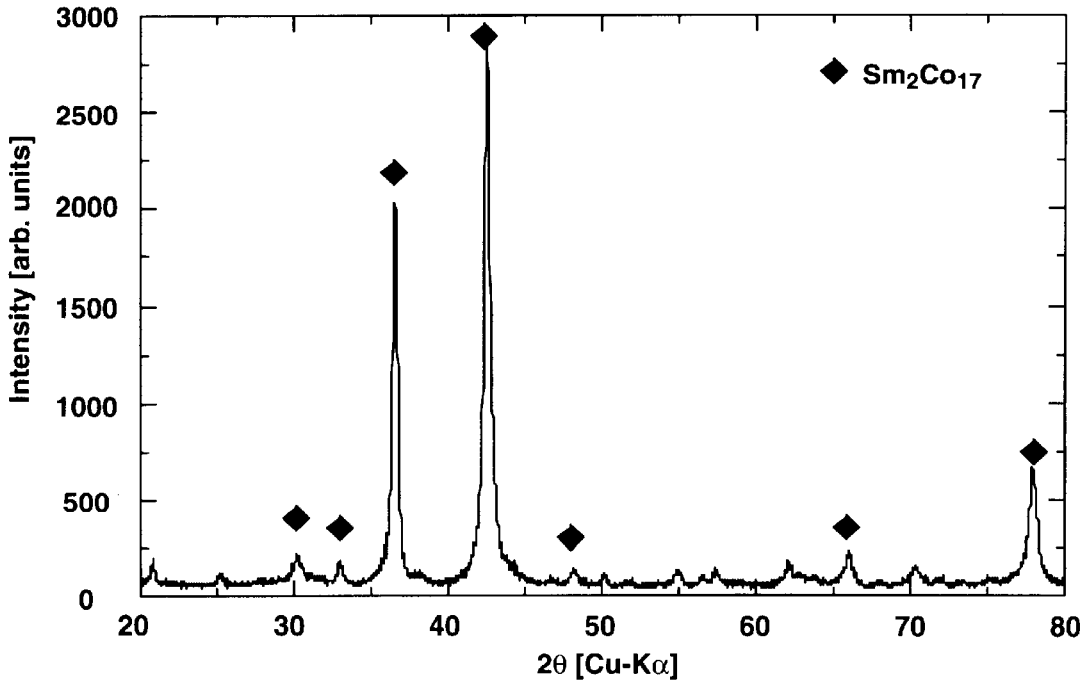
FIG. 10 is an XRD diagram of the magnet of Comparative Example 3.

FIG. 8 is a SEM photomicrograph of the magnet. FIG. 10 is an XRD diagram of the same sample. A comparison is made of FIG. 9 with FIG. 10. In the XRD diagram of Example 7, peaks of Co (bcc and fcc), $CoFe_2O_4$ and $Sm_2O_3$ are found. In the XRD diagram of Comparative Example 3, peaks of $Sm_2Co_{17}$ are found, but not peaks of Co (bcc and fcc), $CoFe_2O_4$ and $Sm_2O_3$.

The magnet sample was subjected to the same hydriding test as in Example 7. The magnet sample was removed from the vessel.

Table 6 sets forth heat treatment conditions, the presence or absence of resin coating, hydriding test conditions, the state after the hydriding test, and the thickness of the composite layer having $CoFe_2O_4$ and/or $Sm_2O_3$ finely dispersed in Co or Co+Fe. After the hydriding test, Examples 7 and 8 remained unchanged, whereas Comparative Example 3 was pulverulent. It is thus evident that Examples 7 and 8 did not undergo hydrogen embrittlement.

TABLE 6

| | Heat treatment | Resin coating | Thickness of composite layer | Hydriding test | After hydriding test |
|---|---|---|---|---|---|
| E7 | 500° C./ 2 hr | coated (20 μm thick) | 20 μm | 3 MPa/25° C./ 24 hr | unchanged |
| E8 | 400° C./ 2 hr | coated (20 μm thick) | 1 μm | | unchanged |
| CE3 | — | not coated | — | | pulverulent |

Table 7 sets forth the magnetic properties of the magnets before and after the heat treatment and after the hydriding test. After the heat treatment and after the hydriding test, the magnetic properties of Examples 7 and 8 remained substantially unchanged, indicating that Examples 7 and 8 prevented degradation of magnetic properties by heat treatment and hydrogen embrittlement. The magnetic properties of Comparative Example 3 after hydriding were unmeasurable because the sample became pulverized by hydriding.

TABLE 7

| | Before heat treatment | | | After heat treatment | | | After hydriding test | | |
|---|---|---|---|---|---|---|---|---|---|
| | Br [kG] | iHc [kOe] | (BH)max [MGOe] | Br [kG] | iHc [kOe] | (BH)max [MGOe] | Br [kG] | iHc [kOe] | (BH)max [MGOe] |
| E7 | 10.90 | 15.35 | 27.32 | 10.88 | 15.60 | 27.12 | 10.89 | 15.62 | 27.18 |
| E8 | 10.85 | 15.53 | 27.10 | 10.80 | 15.75 | 26.94 | 10.82 | 15.74 | 27.02 |
| CE3 | 10.89 | 15.56 | 27.35 | — | — | — | — | — | — |

Table 8 sets forth heat treatment conditions, the presence or absence of resin coating, hydriding test conditions, and the state after the hydriding test. After the hydriding test, Example 9 remained unchanged. It is thus evident that Example 8 did not undergo hydrogen embrittlement and additionally, the resin coating prevented chipping.

TABLE 8

| | Heat treatment | Resin coating | Hydriding test | After hydriding test |
|---|---|---|---|---|
| E9 | 500° C./2 hr | coated | 3 MPa/25° C./24 hr | unchanged |

The sintered $Sm_2Co_{17}$ base magnets of the invention are rare earth magnets suitable for use in motors because the magnets do not undergo hydrogen embrittlement even when exposed to a hydrogen atmosphere for a long period of time. They are effectively prepared by the inventive method.

Japanese Patent Application Nos. 2000-231244 and 2000-231248 are incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A sintered rare earth magnet consisting essentially of 20 to 30% by weight of R wherein R is samarium or at least two rare earth elements containing at least 50% by weight of samarium, 10 to 45% by weight of iron, 1 to 10% by weight of copper, 0.5 to 5% by weight of zirconium, and the balance of cobalt and incidental impurities, said sintered rare earth magnet having on its surface a composite layer containing $Sm_2O_3$ or $CoFe_2O_4$ or both in Co or Co and Fe.

2. The sintered rare earth magnet of claim 1 wherein said composite layer has a thickness of 0.1 μm to 3 mm.

3. A sintered rare earth magnet consisting essentially of 20 to 30% by weight of R wherein R is samarium or at least two rare earth elements containing at least 50% by weight of samarium, 10 to 45% by weight of iron, 1 to 10% by weight of copper, 0.5 to 5% by weight of zirconium, and the balance of cobalt and incidental impurities, said sintered rare earth magnet having on its surface a composite layer containing $Sm_2O_3$ or $CoFe_2O_4$ or both in Co or Co and Fe, said sintered rare earth magnet further comprising a resin coating on said composite layer.

4. The sintered rare earth magnet of claim 3 wherein said resin coating has a thickness of 1 μm to 3 mm.

5. The sintered rare earth magnet of claim 1 having resistance to hydrogen attack.

6. A method for preparing a sintered rare earth magnet, comprising the steps of:

casting an alloy consisting essentially of 20 to 30% by weight of R wherein R is samarium or at least two rare earth elements containing at least 50% by weight of samarium, 10 to 45% by weight of iron, 1 to 10% by weight of copper, 0.5 to 5% by weight of zirconium, and the balance of cobalt and incidental impurities, grinding the alloy, followed by comminution, compacting in a magnetic field, sintering and aging to form a sintered magnet, cutting and/or polishing the sintered magnet for surface finishing, and heat treating in an atmosphere having an oxygen partial pressure of $10^{-6}$ to 152 torr for about 10 minutes to 20 hours so as to form on the surface of the rare earth magnet a composite layer containing $Sm_2O$ or $CoFe_2O_4$ or both in Co or Co and Fe.

7. A method for preparing a sintered rare earth magnet, comprising the steps of: casting an alloy consisting essentially of 20 to 30% by weight of R wherein R is samarium or at least two rare earth elements containing at least 50% by weight of samarium, 10 to 45 by weight of iron, 1 to 10% by weight of copper, 0.5 to 5% by weight of zirconium, and the balance of cobalt and incidental impurities, grinding the alloy, followed by comminution, compacting in a magnetic field, sintering and aging to form a sintered magnet, cutting and/or polishing the sintered magnet for surface finishing, and heating in an atmosphere having an oxygen partial pressure of $10_{-6}$ to 152 torr for about 10 minutes to 20 hours, said method further comprising the step of applying a resin coating on the surface of the sintered magnet after the heat treatment.

8. The method of claim 7 wherein the resin coating is applied by spray coating, electrodeposition, powder coating or dipping.

9. A sintered rare earth magnet of claim 1, wherein said at least two rare earth elements are selected form neodymium (Nd), cerium (Ce), praseodymium (Pr) and gadolinium (Gd).

10. A sintered rare earth magnet of claim 1, wherein said composite layer has a thickness of 1 to 500 $\mu$m.

11. A sintered rare earth magnet of claim 1, wherein said composite layer has a thickness of 1 to 50 $\mu$m.

12. A method according to claim 6, wherein the comminuted powder is compacted in a magnetic field of at least 10 kOe.

13. A method according to claim 6, wherein the comminuted powder is compacted under a pressure of 500 kg/cm$^2$ to less than 2,000 kg/cm$^2$.

14. A method according to claim 12, wherein the comminuted powder is compacted under a pressure of 500 kg/cm$^2$ to less than 2,000 kg/cm$^2$.

15. A method according to claim 6, wherein the compact is sintered in a heating furnace having a non-oxidizing gas atmosphere at a temperature of 1,100 to 1,300° C.

16. A method according to claim 15, wherein the compact is heated for ½ to 5 hours.

17. A method according to claim 6, wherein aging is performed by holding the sintered magnet in an argon atmosphere at a temperature of 700 to 900° C.

18. A method according to claim 6, wherein after the sintering step, the compact is quenched, and the sintered magnet is aged wherein the sintered magnet is held in an argon atmosphere at a temperature of 700 to 900° C. for 5 to 40 hours and cooled at a rate of −1.0° C./min.

19. A method according to claim 6, wherein after surface finishing, the magnet is heat treated in an inert gas, air or vacuum atmosphere having an oxygen partial pressure of 10° to 152 torr.

20. A sintered rare earth magnet of claim 3, wherein said resin is selected from acrylic, epoxy, phenolic, silicone, polyester, polyimide, polyamide and polyurethane resins.

21. A sintered rare earth magnet of claim 3, wherein said resin coating has a thickness of 10 $\mu$m to 1 mm.

22. A sintered rare earth magnet of claim 1, wherein the iron content is 14.0–20.0 wt % Fe.

23. A method according to claim 6, wherein after sintering and before aging, the magnet is subjected to solution treatment.

24. A method for preparing a sintered rare earth magnet, comprising the steps of:

casting an alloy consisting essentially of 20 to 30% by weight of R wherein R is samarium or at least two rare earth elements containing at least 50% by weight of samarium, 10 to 45 by weight of iron, 1 to 10% by weight of copper, 0.5 to 5% by weight of zirconium, and the balance of cobalt and incidental impurities, grinding the alloy, followed by comminution, compacting in a magnetic field, and sintering to form a sintered magnet, cutting and/or polishing the sintered magnet for surface finishing, aging the surface finished sintered magnet, and heat treating in an atmosphere having an oxygen partial pressure of $10_{-6}$ to 152 torr for about 10 minutes to 20 hours so as to form on the surface of the rare earth magnet a composite layer containing $Sm_2O$ or $CoFe_2O_4$ or both in Co or Co and Fe.

* * * * *